United States Patent [19]

Sullivan

[11] Patent Number: 4,658,700

[45] Date of Patent: Apr. 21, 1987

[54] DRUM MAGAZINE

[75] Inventor: Leroy J. Sullivan, Huntington Beach, Calif.

[73] Assignee: The Beta Company, Atlanta, Ga.

[21] Appl. No.: 759,058

[22] Filed: Jul. 24, 1985

[51] Int. Cl.[4] ..... F41D 10/26

[52] U.S. Cl. ..... 89/33.02

[58] Field of Search ..... 42/6, 19, 49 R, 50; 89/33.02

[56] References Cited

U.S. PATENT DOCUMENTS

| | | | |
|---|---|---|---|
| 2,131,412 | 9/1938 | Ostman | 89/33.02 |
| 4,138,923 | 2/1979 | Brosseau et al. | 89/33.02 |
| 4,384,508 | 5/1983 | Sullivan et al. | 89/33.02 |
| 4,413,546 | 11/1983 | Taylor, Jr. | 89/33.02 |
| 4,487,103 | 12/1984 | Atchisson | 89/33.02 |

FOREIGN PATENT DOCUMENTS

| | | | |
|---|---|---|---|
| 726574 | 10/1942 | Fed. Rep. of Germany | 89/33.02 |
| 1553877 | 8/1971 | Fed. Rep. of Germany | 89/33.02 |
| 628734 | 9/1949 | United Kingdom | 89/33.02 |

*Primary Examiner*—Stephen C. Bentley
*Attorney, Agent, or Firm*—Needle & Rosenberg

[57] ABSTRACT

This invention relates to magazines for guns. The drum magazine of the present invention comprises one or two generally cylindrical drums with openings for the exit of cartridges from within the drum. A spring driven rotor within the drum carries two concentric rings of cartridges in a channel defined by the outer circumference of the rotor and the interior of the cylindrical drum wall. The rotor engages the inner concentric ring of cartridges and each cartridge in the outer ring of cartridges is forced to move by contact with a cartridge of the inner ring. During feeding, the cartridges are advanced as two rings until they meet the cam blade, which gradually forces the cartridges into a single column which moves approximately twice as fast as the velocity of the cartridges in the rotor. When the last cartridge leaves the rotor during feeding and enters the exit passage, a follower arm is provided to continue to push the last cartridge out of the magazine.

41 Claims, 8 Drawing Figures

DRUM MAGAZINE

BACKGROUND OF THE INVENTION

This invention relates to magazines for guns. More specifically it relates to large capacity drum magazines which feed cartridges to an automatic gun.

Drum magazines are well known in the art. See for example, U.S. Pat. No. 2,131,412 to Ostman; U.S. Pat. No. 4,138,923 to Brosseau; U.S. Pat. No. 4,384,508 to Sullivan; and U.S. Pat. No. 4,487,103 to Atchisson. The principal advantage of drum magazines over the more conventional box or column magazines is their greater capacity, carrying two to four times the number of cartridges of a box magazine, with correspondingly more firepower. However, such drum magazines are seldom used because they require a special gun.

Rifles are still the predominant infantry weapon today. Modern automatic rifles have two important roles. They must fire accurate single shots, which they do very well, and then by means of a selector button, they must fire fully automatic like a machine gun. The intended purpose of this second role is to eliminate the need for a secondary automatic support weapon by making the rifle an all purpose weapon. In practice, however, the rifle makes a poor machine gun. Its most obvious flaw is its small magazine, usually thirty shots. In a situation that requires full automatic fire, each magazine is emptied so quickly that the soldier must spend more time changing magazines than firing. This "down time" limits the rifle's effect and increases the soldier's vulnerability in combat.

A large capacity drum magazine for the rifle would overcome this problem by increasing the firepower of the rifle. However, existing drum magazine technology is not compatible with existing rifle technology. A gun magazine serves as both an ammunition container and as a feed device. It is, of course, an essential assembly for the gun, but unlike other assemblies within the gun, which are mechanically linked together so that their functions are coordinated, the magazine is a detachable and separate unit. The magazine's drive mechanism, without assist from the gun, must be fast enough to keep up with the gun cycle. In order to provide a large capacity magazine for automatic rifles, such as the M-16, it is necessary to move the mass of cartridges the required distance in the same time as in small capacity magazines originally designed for the gun. However, a larger weight of cartridges requires a larger force to accelerate them, and the force required to move 100 cartridges in a standard magazine design used with an M-16 would place so much force on the cartridge in the feed position that it would impede or jam the weapon mechanism.

Unlike other drum magazines, the present invention, with 100 cartridge capacity, will advance each cartridge into the feed position just as fast and with no greater binding force than for a conventional 30 cartridge magazine. Because of this and the geometry of its construction, the magazine can be used on almost any modern combat rifle without modification to the gun. It does not preclude the use of standard 30 shot magazines, so the two types can be used interchangeably.

Firepower is not always required or desirable, but when it is, the combined limit of existing rifle and magazine technology offers no better solution than a special support weapon or a bigger army. The present invention offers an entirely different solution. When needed, it triples the immediate firepower of every rifleman and reduces his vulnerability in combat.

SUMMARY OF THE INVENTION

A single drum magazine of the present invention comprises a generally cylindrical drum with an opening for the exit of cartridges from within the drum. A spring driven rotor within the drum carries two concentric rings of cartridges, oriented with their axes approximately parallel to the drum axis, in a channel defined by the outer circumference of the rotor and the interior of the cylindrical drum wall. The rotor engages the inner concentric ring of cartridges, and the width of said channel is less than the diameter of two cartridges, such that the outer concentric ring of cartridges is necessarily offset from the cartridges in the inner ring. The cartridges in the outer ring are thereby nested in recesses formed between adjacent cartridges in the inner ring. As a result, when the rotor is caused to rotate, thereby forcing the inner ring of cartridges to move around a circle, each cartridge in the outer ring of cartridges is also forced to move by contact with a cartridge of the inner ring just behind it with respect to the direction of rotation. Also, since the outer ring of cartridges has a greater circumference than the inner ring, there will be gaps between adjacent pairs of outer ring cartridges.

An exit channel between the rotor and the magazine exit reduces the width of the cartridge channel from that of the width of the offset double row of cartridges to that of a single row of cartridges. This reduction in width may be accomplished by means of a cam blade which forces cartridges from the inner ring of cartridges, as they leave the rotor, into the gaps between the cartridges of the outer ring as all of the cartridges move through the narrowing passage. It should be noted that the cartridges will roll during the transition from double column to single column and that rolling friction will thereby apply to ease the merging process. Thus during feeding, the cartridges are driven by the force of the spring and advanced as two rings until they meet the cam blade, which gradually forces the cartridges into a single column which moves approximately twice as fast as the velocity of the cartridges in the rotor, and the magazine will be emptied in about a single rotation of the rotor.

When the last cartridge leaves the rotor during feeding and enters the exit passage, a means is provided to continue to push the last cartridge out of the magazine. This may be accomplished by a follower arm attached to the rotor. Preferably the follower arm is pivotally attached to the rotor at one of its ends, and has a pushing surface at its other end, such as a dummy cartridge. The follower arm retracts within the inner circumference of the inner ring of cartridges when the magazine is loaded and extends outward and into the exit passage as the magazine empties. While the follower arm is optimally designed to force all cartridges out of the magazine, in practice an extension means may be necessary to feed the cartridge into the gun. In such case, an appropriate number of dummy cartridges may either be built within the magazine or loaded into the magazine to fill the additonal length of the extension means when the follower arm is fully extended.

The magazine may be loaded by hand or machine by reversing the feeding process and introducing cartridges into the feed end of the magazine. As each cartridge is introduced, the preceding cartridges will move into the magazine and automatically expand into the two concentric offset rings of cartridges, causing the rotor to rotate against the spring force until the magazine is filled to capacity.

Another embodiment of the present invention utilizes two of the drum magazines described above joined together at their respective exit openings by a connection means which directs the cartridges exiting from each drum into a feed box or extension located centrally between the drums. This is especially desirable in the case of a gun, such as an M-16, which normally utilizes a conventional double column box magazine. In this case, the cartridges exiting from each of the drums are directed to form the two staggered columns of cartridges in the central box. The drums are separated far enough from the central box to accomodate the width of the gun receiver between them when the central box is fitted within the gun. This embodiment forms a unit which is more compact than a single drum of the same cartridge capacity, fits the gun more favorably with more handling and ground clearance, and maintains the advantages of the invention as described below.

The invention overcomes the difficulties inherent in the prior art by reducing the spring force necessary to move the desired mass of cartridges in the required time and by reducing the resultant force exerted by the cartridge to be fed into the gun for a given spring force. That is, since two rings of cartridges in the drum produce a single row of cartridges exiting the drum, to move a new cartridge into the loading position the total mass of cartridges need only be moved approximately half the distance that would be required in a prior art drum. This allows a reduction in the spring force by about a factor of two from what would be normally required to move the cartridges in the time necessary to meet the cycle time of the automatic gun. In addition, the effect of the gradual merging action from two rows to one row, and the resultant acceleration of the cartridges, is to reduce the force on a cartridge exiting the drum from the force which the spring applies to the cartridges within the magazine. This effect also helps to make possible the high speed feeding of a larger volume of cartridges without adversely affecting the gun loading mechanism.

Some box magazines have been designed which incorporate a reduction of a double column of cartridges to a single column. However, such box magazines do not have the gap between cartridges at the start of the transition from a double row to a single row, and, therefore, tend to bind, which inhibits smooth acceleration of the cartridges.

The simplicity of the design of the internal mechanism of the invention lends itself to less costly manufacturing since the magazine may be constructed with modern production methods and materials, such as by metal stampings or plastic molds. Such a magazine may be lightweight and disposable, and such features will be especially beneficial for military use.

In summary, it is an object of this invention to provide a magazine that will hold a large number of ammunition rounds, which may function on any unmodified magazine gun or rifle and which, therefore, does not require a special gun for its operation.

It is a further object of this invention to provide a magazine for an automatic gun or rifle which can feed a large number of cartridges to the weapon without retarding the weapon mechanism.

It is a still further object of this invention to provide a large capacity magazine which is simple in design, economical in construction, lightweight and compact.

These and other objects and advantages will appear from the following description with reference to the drawings.

DESCRIPTION OF THE PREFERRED EMBODIMENTS

The preferred embodiments are now described with reference to the drawings, in which like numbers indicate like parts throughout the views.

Figure 1:
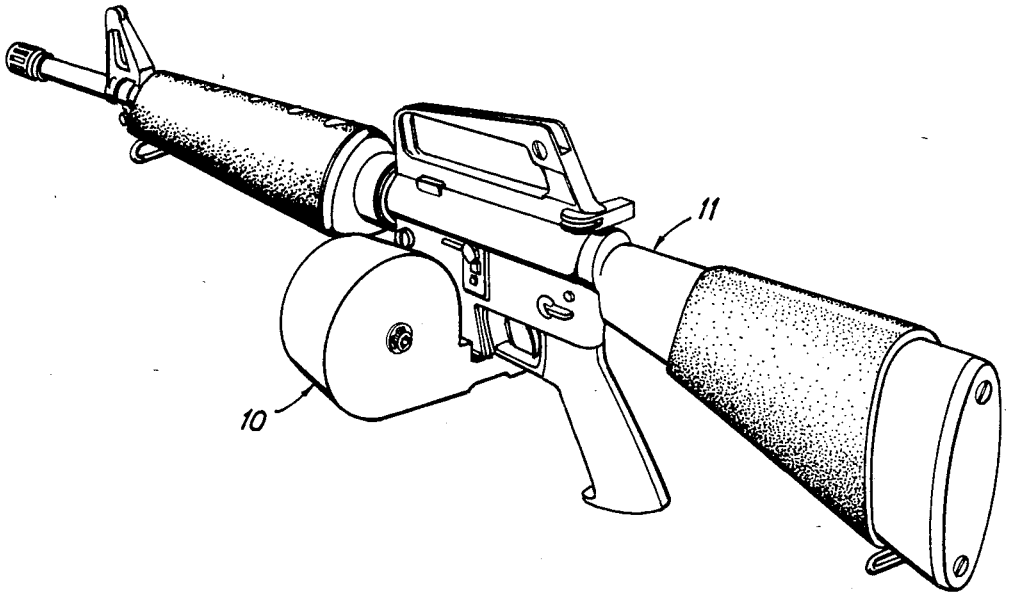
FIG. 1 is a perspective view of an automatic rifle with a double drum magazine attached thereto.
Figure 2:
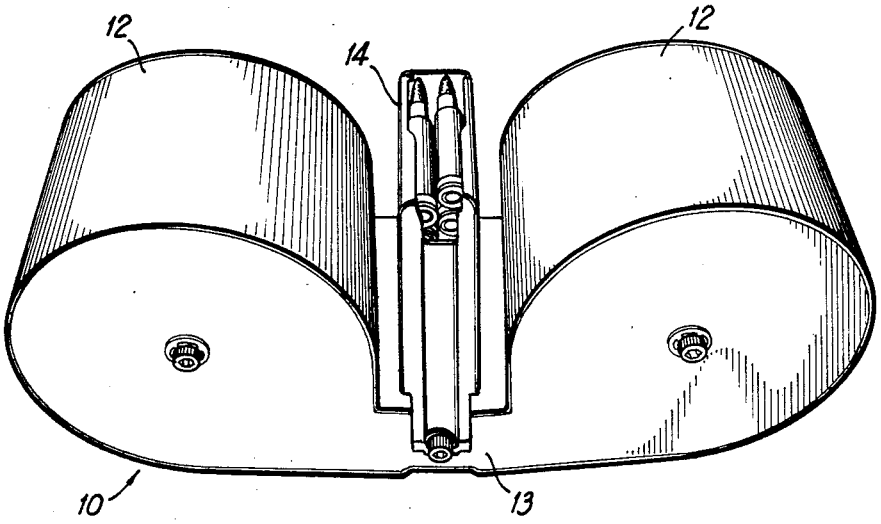
FIG. 2 is a perspective view of a double drum magazine.

FIG. 1 shows a double drum magazine 10 attached to an automatic rifle 11, such as an M-16. FIG. 2 shows the double drum magazine 10 which includes two drum portions 12 connected together by connection means 13, and a cartridge feed extension 14 attached to said connection means. It can be seen that extension 14 is of the double row type and is adapted to the shape and dimensions of at least the portion of the standard box clip which mates with the rifle.

Figure 3:
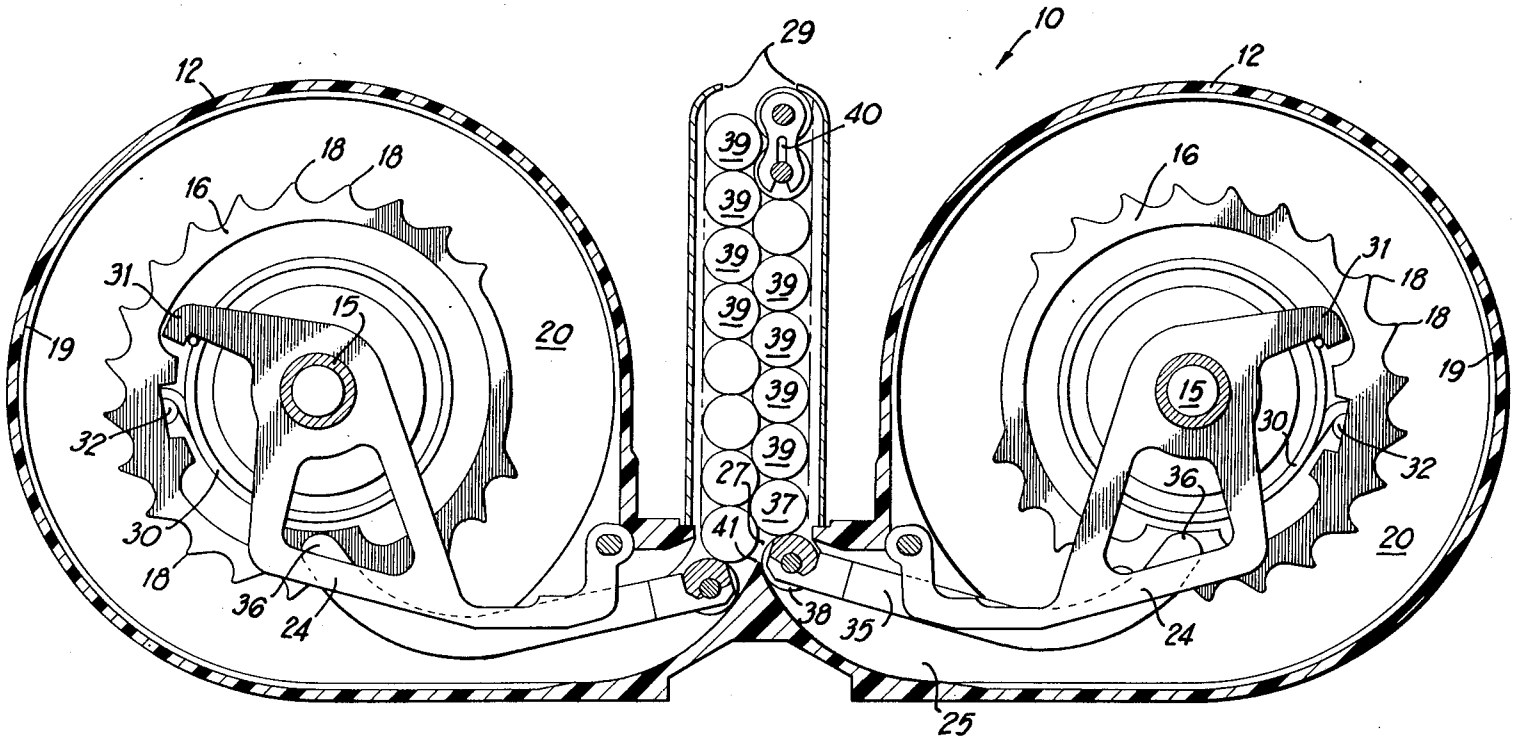
FIG. 3 is a cross-sectional view of a double drum magazine embodiment of the present invention, fully unloaded.
Figure 4:
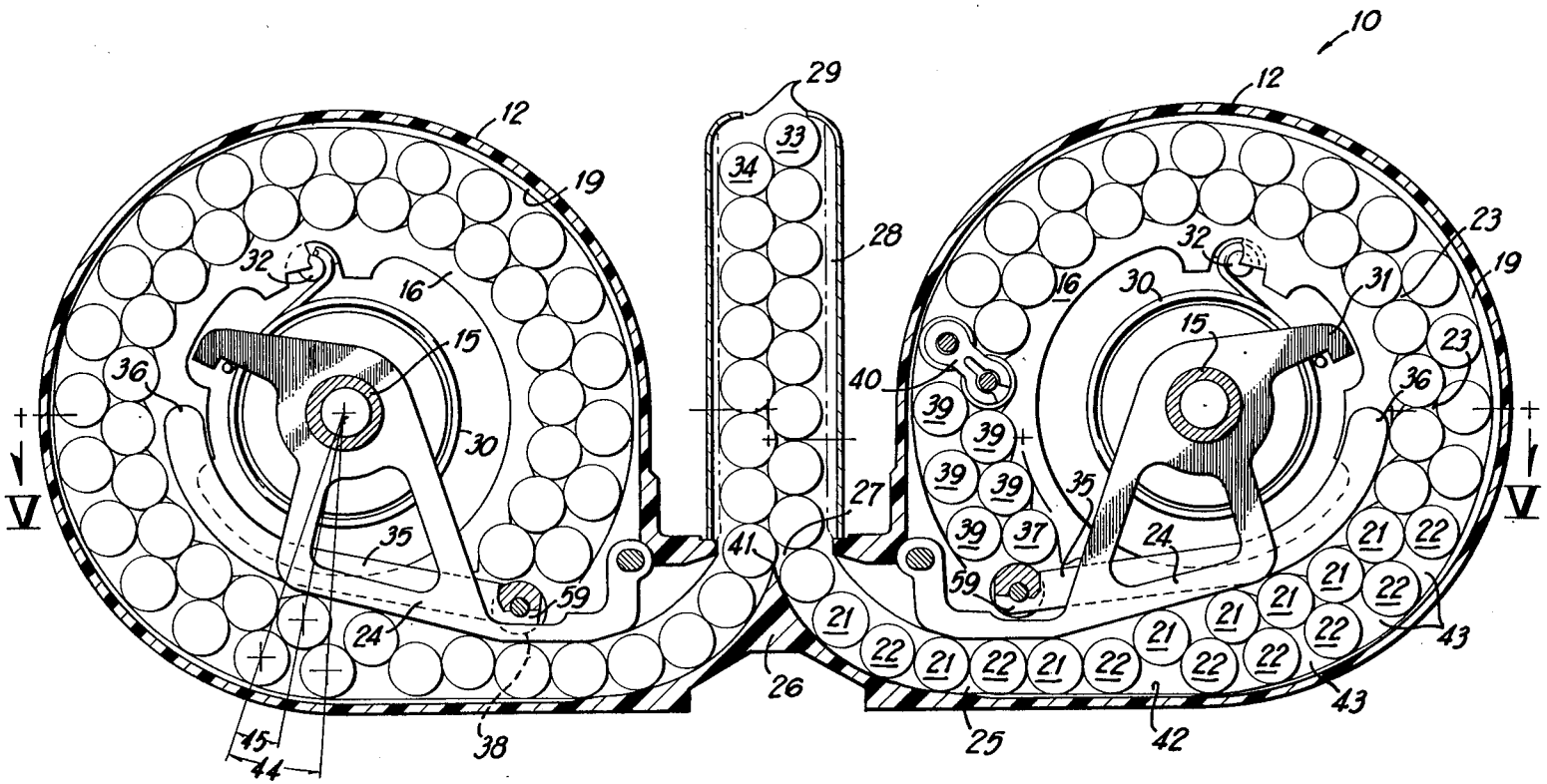
FIG. 4 is the magazine of FIG. 3 fully loaded with cartridges.

FIG. 3 shows in detail a double drum embodiment of the present invention. Each drum portion 12 of the magazine is essentially an identical mirror-image of the other. Each drum has a central shaft or axel 15 upon which rotate the rotors. It will be seen below that the rotor comprises two wheels. The front wheel 16 is seen in FIG. 3. Each wheel has teeth 18 which provide a partial arc between each pair of teeth within which a cartridge may be seated. The magazine has a generally cylindrical wall 19 concentric with the circumference of the rotor wheels. A space 20 is provided between the rotors and the inside of the drum which forms a channel around the circumference of the rotor. This channel is optimally of a width just sufficient to hold two offset concentric rings of cartridges. FIG. 4 shows the magazine of FIG. 3 fully loaded with cartridges and shows the two concentric rings of cartridges within the channel space 20. The cartridges 21 in the inner ring of cartridges are located in the spaces between the teeth of the rotor wheels and the cartridges 22 in the outer ring are each located in a recess 23 formed between two adjacent cartridges in the inner ring.

With further reference to both FIGS. 3 and 4, it is seen that a cam blade 24 is provided which gradually reduces the width of the channel 20 from that of the two offset rows of cartridges at the rotors to a single row of cartridges at the exit 25 from each drum portion 12. The connection 26 between the two drum portions 12 directs the two single cartridge rows from each of the drum portions towards one outlet 27 which is only wide enough to allow the two rows of cartridges to pass through if they are staggered. An extension 28 is attached to the connection 26 which carries the two staggered rows of cartridges to a standard double lip feed throat 29.

The motion of the cartridges out of the magazine is caused by coiled springs 30 located at the center of each drum portion. Each spring is tensioned between a tab extension 31 of the cam blade 24 and a connection 32 to the rotor wheels, thereby forcing the rotors to turn in the direction that will move the cartridges into the cam area and out of the drum. Thus, it can be seen that as the lead cartridge 33 is removed from the feed throat 29 the spring force on the rotors will cause the rotors to rotate and all of the cartridges to move in the direction of the feed throat until the top cartridge 34 from the other staggered row is stopped by the lip of the feed throat.

A follower arm 35 is attached to a pivot 36 on each rotor. As the last cartridge 37 on the rotor is cammed away from the rotor teeth by the cam blade 24, the follower arm 35 continues to transfer the force of the spring to the last cartridge to cause the cartridges to continue to move out of the magazine as cartridges are removed from the feed throat. The follower arm is shaped to fit within the inner ring of cartridges when the magazine if fully loaded. The push end of the follower arm has a dummy cartridge 38 attached thereto which occupies a space in the outer ring of cartridges. As the dummy cartridge 38 enters the area of the cam blade 24 when the magazine is being unloaded, it naturally moves toward the exit passage of the drum portion, which causes the follower arm 35 to swing outward and into the exit passage. As can be seen in FIG. 3, the follower arms 35 are of sufficient length to push the cartridges out of the drum, through the connection 26 and the outlet 27. However, the follower arm 35 does not extend into the extension 28, and as seen in FIG. 3, it is necessary that this space be filled with cartridges, which may be dummy cartridges. Even with such dummy cartridges 39, the number of which is dependent on the length of the extension 28, this embodiment of the magazine is capable of carrying and delivering one-hundred rounds to a weapon. A link 40 is provided between the dummy cartridge that is the lead cartridge when the magazine is completely unloaded and the cartridge in its row immediately behind it, to prevent the weapon from loading the dummy cartridge and to indicate that the magazine is empty.

The magazine may be loaded by inserting cartridges into the feed throat 29. Each time a cartridge is loaded the cartridges within the extension 28 will be pushed downward toward the dividing point 41 in the connection, which naturally causes the two staggered rows to be split and directed into each of the drums. During loading the follower arm dummy cartridge 38 is naturally caused to be pushed to a position in the outer ring since the angle of the force applied to the dummy cartridge 38 causes it to rotate outward on its arc of travel. The succeeding cartridges entering the drum will naturally alternate moving into the inner ring or outer ring of cartridges due to the position of the preceding cartridge. The loading of cartridges will cause the rotor wheels 16 to turn against the spring force, first by the force applied to the follower arm, and after the cartridges in the inner ring begin to be located within the teeth of the rotor, by the force applied directly to the rotor. Cartridges may be loaded until the rotors make a complete revolution and the cartridge end of the follower arm comes into contact with the back of the cam blade 24.

Figure 5:
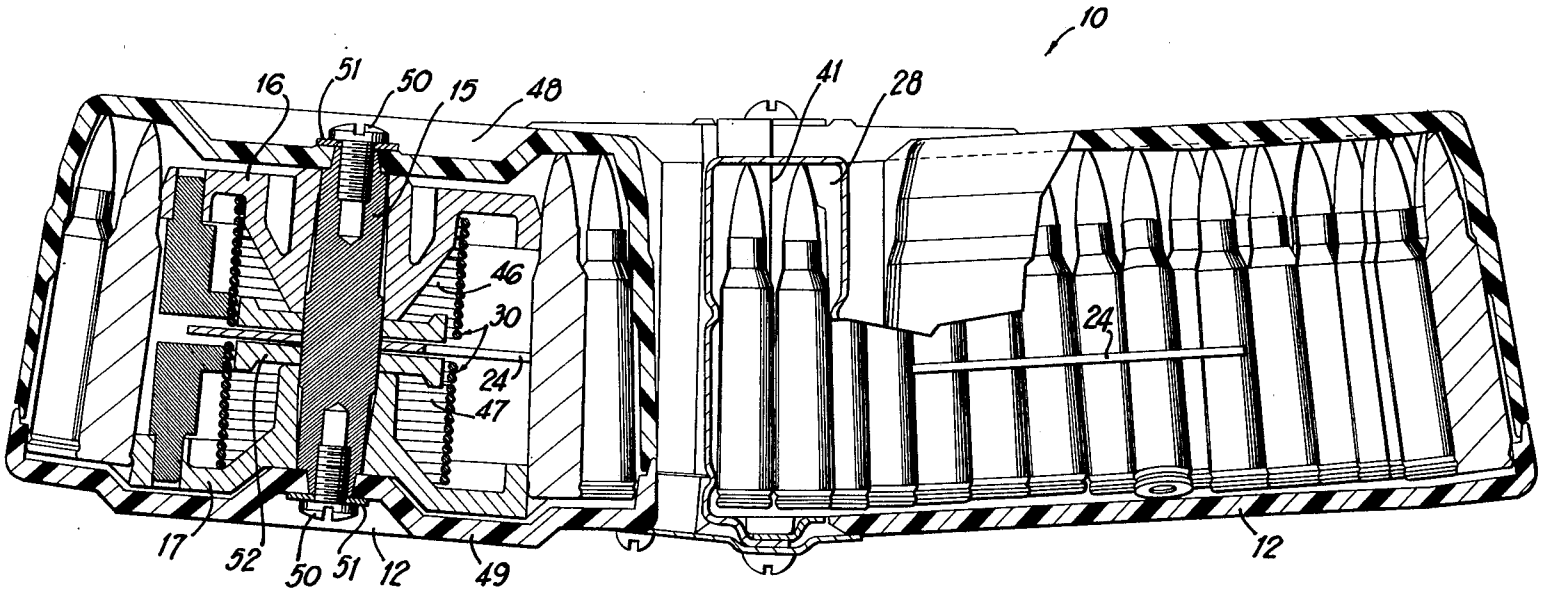
FIG. 5 is a section taken along the line V—V of FIG. 4.

With reference to FIGS. 4 and 5, it is seen that as the cartridges enter the cam area during unloading the cam blade 24 squeezes the two rings of cartridges into one row. By reference to the right cam blade 24 in FIG. 5, it is seen that the cam blade is generally centrally located between the ends of the cartridges so that each cartridge from the inner ring is cammed into the space between adjacent cartridges in the outer ring by the relatively thin cam blade 24 as a fulcrum. Since cartridges may be tapered, the thin cam blade acts as a fulcrum point contact allowing either end of the cartridge to go deeper into the path of the outer ring as room allows so that any slack at the front or rear of the single column is taken up. Furthermore, as seen in FIG. 5, the drums 12 are tilted slightly forward, as is the central box extension 28, to compensate for the accumulated angles of taper of the cartridges in the cam area, connection and extension.

Cartridges roll during the transition from double column to single column in the cam area, and, therefore, rolling friction applies, not sliding friction. However, in order to have the cartridges cam smoothly the camming should be gradual. In this embodiment, an angle of about 15 degrees is made between the cam blade 24 and the tangential portion 42 of the inside face of the drum, which is about the maximum angle that will cam smoothly. Also, for smooth camming, it is important for the camming process to begin before the gap 43 between two adjacent cartridges in the outer ring begins to close, which will occur when each cartridge in the outer ring reaches the tangential drum portion 42. In the embodiment shown in FIG. 4, the angle 44 formed between adjacent cartridges in either the inner or outer ring is 15 degrees, and therefore the angle 45 between a cartridge in the inner ring and a cartridge in the outer ring is 7½ degrees. Therefore, the cam blade should begin camming a cartridge in the inner ring at least 7½ degrees before the beginning of the tangential portion 42 of the drum. In general, the angle between the cam blade 24 and the tangential portion 42 of the drum may be chosen as being about equal to the angle 44 formed between adjacent cartridges in the inner ring.

It is also important that the teeth 18 of the rotors 16, 17 do not extend so far that they will impede an inner ring cartridge from moving forward in the cam area as necessarily caused by the camming of cartridges behind it.

FIG. 5 also shows in greater detail the front wheel 16 and rear wheel 17 of the rotor on their axel 15. The spring 30 is seen to be two inverse coiled spring portions 46, 47, which may be formed with a single wire with the center of the spring anchored to the cam blade.

Figure 6:
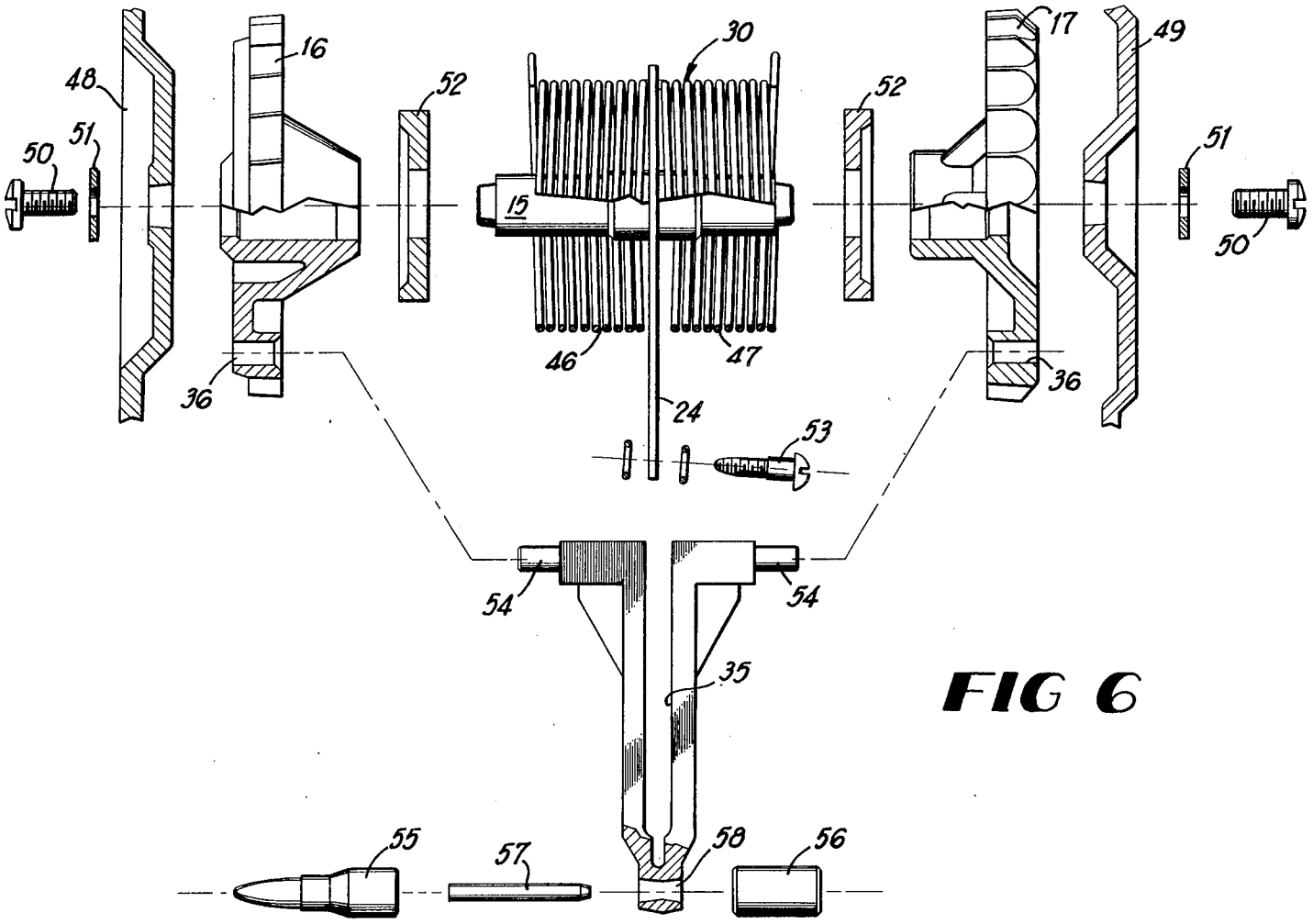
FIG. 6 is an exploded view of the internal parts of the magazine and a portion of the drum walls, some of which are in partial or complete cross-section.

FIG. 6 is an exploded drawing of the elements inside the drum, showing the parts in greater detail. The part numbers are the same as previously used, with a cut away portion of the front face 48 and rear face 49 of the drum shown through which the screws 50 and washers 51 attach to the axel 15. Spacers 52 are provided to support the spring 30 and reduce the friction of rotation of the wheels 16, 17. The cam blade 24 is mounted around the axel and is anchored to the drum by means of a screw 53.

The follower arm 35 is seen to have a U-shape with cylindrical extensions 54 which fit into the pivot holes 36 of the front and rear wheels. The follower arm dummy cartridge comprises an appropriately shaped head 55 and tail 56 portion attached to a pin 57 through a hole 58 through the push end of the follower arm. The hole 58 is slightly larger than the pin and tapered outward at both openings to allow the dummy cartridge to rotate and tilt as it moves through the cam area.

Figure 7:
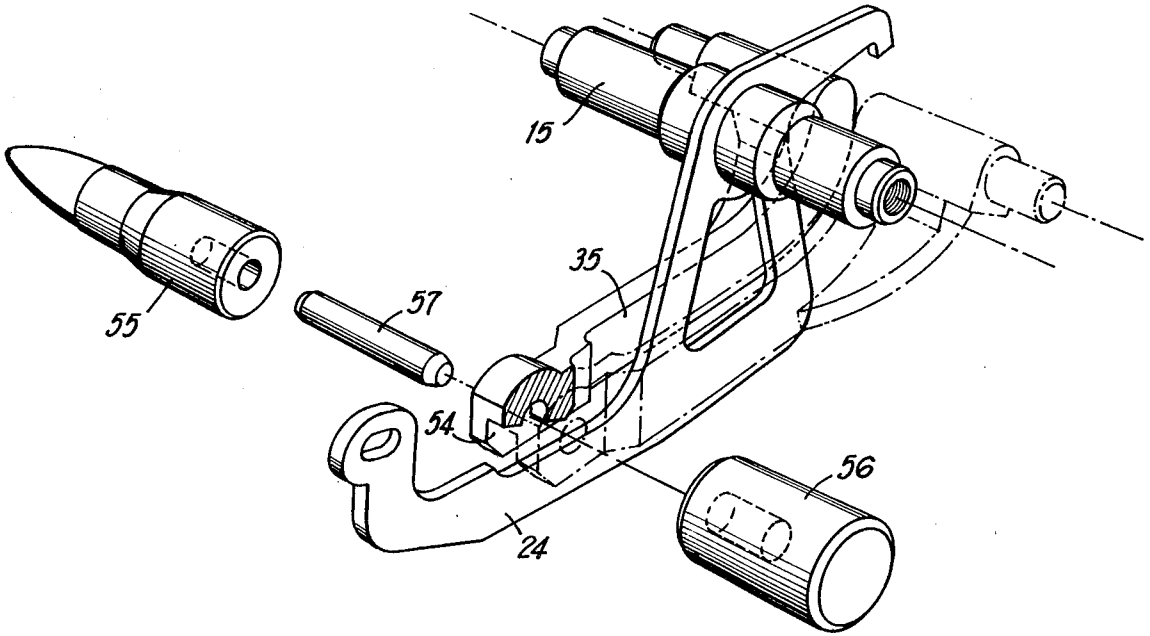
FIG. 7 is a perspective view of the internal parts of the drum.

The U-shaped opening of the follower arm is necessary to allow the arm to fit around the cam blade 24 both when fully loaded (see FIG. 4) and fully unloaded (see FIG. 3). FIG. 7 is a perspective view which more clearly shows the interaction of the follower arm 35 and the cam blade 24. A portion of the push end of the follower arm is cut away 59 where the follower arm will come into contact with the cam blade when the drum is fully loaded, to provide room for an additional cartridge to be loaded into the magazine.

Figure 8:
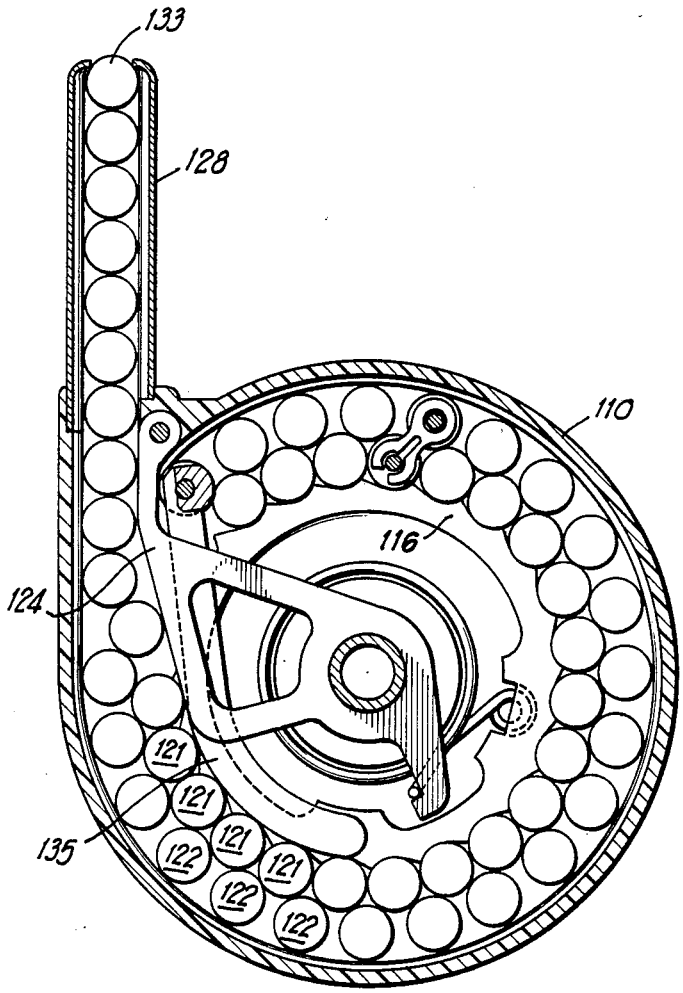
FIG. 8 is a cross-sectional view of a single drum magazine embodiment of the present invention.

FIG. 8 shows a single drum embodiment 112 of the present invention. The parts and operation of this embodiment are essentially the same as described above, with a rotor 116 on an axel 115 moving an inner ring of cartridges 121 and an outer ring of cartridges 122 around the drum 112 and directing the cartridges 121 and 122 into a single row by means of the cam blade 124 as the lead cartridges 133 are removed. A follower arm 135 is utilized to push out the last cartridge as described for the double drum configuration. However, no connection (such as 26) is required and the extension 128 carries a single row of cartridges.

The magazine of the present invention may be made of any suitable materials, such as metals and plastics. Ideally, the drums and connections will be formed as a one piece plastic in a molding process, with as many other parts as appropriate made of plastic, to produce the lightest possible product consistent with durability and reliable operation. Any implementation of the invention should be appropriately sized based on the dimensions of the cartridges to be stored therein.

While the invention has been described in detail with particular reference to the preferred embodiments thereof, it will be understood that variations and modifications can be effected within the spirit and scope of the invention as previously described and as defined by the claims.

What is claimed is:

1. A drum magazine for successively feeding a plurality of cartridges to a firearm, comprising:

(a) a drum shaped housing means having a cartridge exit opening extending from the side of said housing means;

(b) rotational cartridge carrying means within said housing means which defines a cartridge space, between said cartridge carrying means and the inner wall of said housing means, for two offset concentric rings of cartridges, wherein each of the cartridges of the outer concentric ring are nested in the recess formed by two adjacent cartridges in the inner concentric ring of cartridges and are urged to revolve around said drum by the rearward of said adjacent cartridges in the inner ring of cartridges, said rotational cartridge carrying means comprising means for individually defining the positions of each cartridge of the inner ring of cartridges and for individually urging each of said cartridges of the inner ring of cartridges to revolve around said drum as said cartridge carrying means rotates; and (c) cam means within said housing means defining, with said housing means, a passage from the cartridge space to the exit opening of said housing means, for urging two offset concentric rings of cartridges alternately together into a single row as said cartridges are moved out of said magazine.

2. The drum magazine of claim 1, further comprising:

(d) extension means associated with said housing means and defining a cartridge feeding channel in communication with the exit opening of said housing means; and (e) drive means to rotationally urge said cartridge carrying means in the direction which will move cartridges within said drum magazine into the passage defined by said cam means and said housing means.

3. The drum magazine of claim 2, wherein said drive means comprises a spring.

4. The drum magazine of claim 1, wherein said means for individually defining the positions of the inner ring of cartridges and for individually urging the cartridges comprises teeth on the outer circumference of said rotational cartridge carrying means.

5. The drum magazine of claim 4, wherein said drum shaped housing means comprises a front face and a rear face and wherein said rotational cartridge carrying means comprises:

(a) a shaft located at the central axis of said housing means, attached to the front and rear faces of said housing means;

(b) a front wheel rotationally mounted on said shaft; and (c) a rear wheel rotationally mounted on said shaft.

6. The drum magazine of claim 1, wherein said drum shaped housing means comprises a front face and a rear face and wherein said cam means comprises a blade connected to said housing means having an edge which defines the passage with said housing means, said blade located between the front and rear faces of said housing means such that the edge of said blade comes into contact with a cartridge exiting from the inner ring at a point significantly away from either end of the cartridge.

7. The drum magazine of claim 6, wherein said means for individually defining the positions of the inner ring of cartridges and for individually urging the cartridges comprises teeth on the outer circumference of said rotational cartridge carrying means.

8. The drum magazine of claim 7, wherein said rotational cartridge carrying means comprises:

(a) a shaft located at the central axis of said housing means, attached to the front and rear faces of said housing means;

(b) a front wheel rotationally mounted on said shaft; and (c) a rear wheel rotationally mounted on said shaft.

9. The drum magazine of claim 8, which further comprises a spring to rotationally urge said cartridge carrying means in the direction which will move cartridges within said drum magazine into the passage defined by said cam means and said housing means.

10. The drum magazine of claim 9, which further comprises a follower means attached to said cartridge carrying means for pushing out of the magazine the last cartridge after it has left said rotational cartridge carrying means during unloading of the magazine.

11. The drum magazine of claim 10, wherein said follower means comprises:

(a) a cylindrical leading projection which has approximately the same external dimensions as a cartridge and which occupies a position in the outer ring of cartridges when the follower means is not extended; and (b) an arm which is attached at one end to said leading projection, is pivotally attached at the other end to the cartridge carrying means at a point interior of the inner ring of cartridges, and is curved to fit within the inner ring of cartridges when the magazine is loaded and to extend into the exit passage when the magazine is empty.

12. The drum magazine of claim 11, wherein:

(a) said cam blade is also supported by said shaft and is located between said front and rear wheels; and (b) said spring is a double torsion spring, the center of said spring being U-shaped to engage said cam blade, and the front half of said spring being connected to drive said front wheel and the rear half of said spring is connected to drive said rear wheel.

13. The drum magazine of claim 12, wherein:

(c) said follower means is connected at its non-leading end to said front and rear wheels thereby coordinating the movement of said wheels; and (d) said follower means arm is split along its length, except for said leading projection end thereof, to accommodate said cam blade as the wheels rotate.

14. The drum magazine of claim 10, wherein:

(a) said follower means is connected at its non-leading end to said front and rear wheels, thereby coordinating the movement of said wheels; and (b) said follower means arm is split along its length, except for said leading projection end thereof, to accommodate said cam blade as the wheels rotate.

15. The drum magazine of claim 6, wherein the blade of said cam means forms one side of an exit passage having an angle of 15 degrees or less with respect to the other side of the exit passage.

16. The drum magazine of claim 6, wherein the blade of said cam means forms one side of an exit passage having an angle equal to the angle between the cartridges in the inner ring with respect to the other side of the exit passage.

17. The drum magazine of claim 6, wherein the blade of said cam means is tangential to the inner circumference of the inner ring of cartridges, and the inner face of said housing means at the exit passage is tangential to the outer circumference of the outer ring of cartridges.

18. The drum magazine of claim 17, wherein the blade of said cam means is positioned with respect to the tangential portion of the inner face of said housing means such that each cartridge of the inner ring reaches said cam means prior to either of the respective adjacent cartridges of the outer ring reaching the tangential portion of the inner face of said housing means, thereby causing each cartridge of the inner ring to be cammed into the gap between the adjacent cartridges of the outer ring before the gap would begin to close.

19. A magazine for successively feeding a plurality of cartridges to a firearm, comprising:

(a) two drum shaped housing means, each having a cartridge exit opening extending from the side of said housing means;

(b) connecting means for joining each of said housing means at the exit openings of each of said housing means, said connecting means having passages within for receiving single rows of cartridges exiting from the exit openings of each of said housing means and merging the two rows of cartridges into a staggered double row of cartridges as they exit said connecting means;

(c) extension means extending from said connecting means for placement in round-feeding relation with a firearm, said extension having a round-feeding opening and having a passage from said connecting means to the round-feeding opening approximately the width of a staggered double row of cartridges;

(d) rotational cartridge carrying means within said housing means which defines a cartridge space, between said cartridge carrying means and the inner wall of said housing means, for two offset concentric rings of cartridges, wherein each of the cartridges of the outer concentric ring are nested in the recess formed by two adjacent cartridges in the inner concentric ring of cartridges and are urged to revolve around said drum by the rearward of said adjacent cartridges in the inner ring of cartridges, said rotational cartridge carrying means comprising means for individually defining the positions of each cartridge of the inner ring of cartridges and for individually urging each of said cartridges of the inner ring of cartridges to revolve around said drum as said cartridge carrying means rotates; and (e) cam means within said housing means defining, with said housing means, a passage from the cartridge space to the exit opening of said housing means for urging two offset concentric rings of cartridges alternately together into a single row as said cartridges are moved out of said magazine.

20. The drum magazine of claim 19, wherein said means for individually defining the positions of the inner ring of cartridges and for individually urging the cartridges comprises teeth on the outer circumference of said rotational cartridge carrying means.

21. The drum magazine of claim 20, wherein said drum shaped housing means comprises a front face and a rear face and wherein said rotational carrying means comprises:

(a) a shaft located at the central axis of said housing means, attached to the front and rear faces of said housing means;

(b) a front wheel rotationally mounted on said shaft; and (c) a rear wheel rotationally mounted on said shaft.

22. The drum magazine of claim 21, which further comprises a spring to rotationally urge said cartridge carrying means in the direction which will move cartridges within said drum magazine into the passage defined by said cam means and said housing means.

23. The drum magazine of claim 19, wherein said drum shaped housing means comprises a front face and a rear face and wherein said cam means comprises a blade connected to said housing means having an edge which defines the passage with said housing means, said blade located between the front and rear faces of said housing means such that the edge of said blade comes into contact with a cartridge exiting from the inner ring at a point significantly away from either end of the cartridge.

24. The drum magazine of claim 23, wherein said means for individually defining the positions of the inner ring of cartridges and for individually urging the cartridges comprises teeth on the outer circumference of said rotational cartridge carrying means.

25. The drum magazine of claim 24, wherein said rotational cartridge carrying means comprises:

(a) a shaft located at the central axis of said housing means, attached to the front and rear faces of said housing means;
(b) a front wheel rotationally mounted on said shaft; and
(c) a rear wheel rotationally mounted on said shaft.

26. The drum magazine of claim 25, which further comprises a spring to rotationally urge said cartridge carrying means in the direction which will move cartridges within said drum magazine into the passage defined by said cam means and said housing means.

27. The drum magazine of claim 26, which further comprises a follower means attached to said cartridge carrying means for pushing out of the magazine the last cartridge after it has left said rotational cartridge means during unloading of the magazine.

28. The drum magazine of claim 27, wherein said follower means comprises:
(a) a cylindrical leading projection which has approximately the same external dimensions as a cartridge and which occupies a position in the outer ring of cartridges when the follower means is not extended; and
(b) an arm which is attached at one end to said leading projection, is pivotally attached at the other end to the cartridge carrying means at a point interior of the inner ring of cartridges, and is curved to fit within the inner ring of cartridges when the magazine is loaded and to extend into the exit passage when the magazine is empty.

29. The drum magazine of claim 28, wherein:
(a) said cam blade is also supported by said shaft and located between said front and rear wheels; and
(b) said spring is a double torsion spring, the center of said spring being U-shaped to engage said cam blade, and the front half of said spring being connected to drive said front wheel and the rear half of said spring being connected to drive said rear wheel.

30. The drum magazine in claim 29, wherein:
(c) said follower means is connected at its non-leading end to said front and rear wheels, thereby coordinating the movement of said wheels; and
(d) said follower means arm is split along its length, except for said leading projection end thereof, to accommodate said cam blade as the wheels rotate.

31. The drum magazine of claim 27, wherein:
(a) said follower means is connected at its non-leading end to said front and rear wheels, thereby coordinating the movement of said wheels; and
(b) said follower means arm is split along its length, except for said leading projection end thereof, to accommodate said cam blade as the wheels rotate.

32. The drum magazine of claim 23, wherein the blade of said cam means forms one side of an exit passage having an angle of 15 degrees or less with respect to the other side of the exit passage.

33. The drum magazine of claim 23, wherein the blade of said cam means forms one side of an exit passage having an angle equal to the angle between the cartridges in the inner ring with respect to the other side of the exit passage.

34. The drum magazine of claim 23, wherein the blade of said cam means is tangential to the inner circumference of the inner ring of cartridges, and the inner face of said housing means at the exit passage is tangential to the outer circumference of the outer ring of cartridges.

35. The drum magazine of claim 34, wherein the blade of said cam means is positioned with respect to the tangential portion of the inner face of said housing means such that each cartridge of the inner ring reaches said cam means prior to either of the respective adjacent cartridges of the outer ring reaching the tangential portion of the inner face of said housing means, thereby causing each cartridge of the inner ring to be cammed into the gap between the adjacent cartridges of the outer ring before the gap would begin to close.

36. The drum magazine of claim 19, wherein said two drum shaped housing means and said connecting means comprise one unified piece.

37. A method of storing cartridges and feeding cartridges into a firearm comprising the steps of:
(a) storing said cartridges in two staggered concentric rings within a cylindrical drum, such that a cartridge of the outer concentric ring is nested in each of the recesses formed by two adjacent cartridges of the inner ring of cartridges;
(b) individually urging each of the cartridges in the inner ring of cartridges such that said staggered rings of cartridges revolve together around the cylindrical drum;
(c) directing the leading end of said two staggered rings of cartridges towards an exit of said cylindrical drum; and
(d) camming said two staggered rings of cartridges together into a single row of cartridges as said cartridges exit said cylindrical drum.

38. The method of claim 37, wherein the step of camming said two staggered rows is initiated for each cartridge of the inner row prior to the point where the two adjacent cartridges in the outer row leave the circle originally formed by said outer ring, so that each cartridge of the inner ring is cammed into the gap between the adjacent cartridge of the outer ring before the gap would begin to close.

39. The method of claim 37, which further comprises the step of directing said cartridges exiting said cylindrical drum into the firearm.

40. The method of claim 39, which further comprises the steps of:
(a) directing the single rows of cartridges exiting from two of said cylindrical drums so that they reform as staggered rows of cartridges prior to feeding said cartridges into a firearm;
(b) directing said two staggered rows of cartridges into the firearm; and
(c) repeatedly lifting the leading cartridge of said two staggered rows of cartridges into the feed position of a firearm.

41. The method of claim 37, wherein the cartridges exiting said cylindrical drum move about twice the distance as the cartridges within said cylindrical drum.

* * * * *